US011247110B2

(12) United States Patent
Lebeaume

(10) Patent No.: US 11,247,110 B2
(45) Date of Patent: Feb. 15, 2022

(54) GOLF TRAINING DEVICE

(71) Applicant: DECATHLON, Villeneuve d'Ascq (FR)

(72) Inventor: Clément Lebeaume, Villeneuve d'Ascq (FR)

(73) Assignee: DECATHLON, Villeneuve d'Ascq (FR)

( * ) Notice: Subject to any disclaimer, the term of this patent is extended or adjusted under 35 U.S.C. 154(b) by 0 days.

(21) Appl. No.: 16/971,374

(22) PCT Filed: Feb. 19, 2019

(86) PCT No.: PCT/EP2019/054060
§ 371 (c)(1),
(2) Date: Aug. 20, 2020

(87) PCT Pub. No.: WO2019/162257
PCT Pub. Date: Aug. 29, 2019

(65) Prior Publication Data

US 2020/0384336 A1 Dec. 10, 2020

(30) Foreign Application Priority Data

Feb. 23, 2018 (FR) ..... 1851577

(51) Int. Cl.
*A63B 69/36* (2006.01)

(52) U.S. Cl.
CPC ..... *A63B 69/3676* (2013.01)

(58) Field of Classification Search
CPC ..... A63B 63/06; A63B 69/3676; A63B 71/04; A63B 57/40; A63B 57/357
USPC ..... 473/159, 174–196; 273/391, 392
See application file for complete search history.

(56) References Cited

U.S. PATENT DOCUMENTS 1,427,537 A * 8/1922 McLean ..... A63B 69/3676 473/187
1,513,917 A 4/1924 Long
1,619,580 A * 3/1927 McLean ..... A63F 7/305 273/127 R (Continued)

FOREIGN PATENT DOCUMENTS

FR 3052674 A1 12/2017
GB 191422584 A 3/1915
GB 195328 A1 3/1923

OTHER PUBLICATIONS

International Search Report issued in corresponding application No. PCT/EP2019/054069, dated Jun. 6, 2019.

*Primary Examiner* — Sebastiano Passaniti
(74) *Attorney, Agent, or Firm* — Murtha Cullina LLP

(57) ABSTRACT

The invention relates to a golf training device comprising an annular support with a hole for a golf ball is formed. The support being provided with a plurality of members angularly distributed with each member having an external ramp and an internal ramp. The ramps are arranged to have a stable state with the external ramp arranged in a plane of access to the hole. The internal ramp is arranged protruding around the hole, and a state constrained by the passage of the ball on the member wherein the internal ramp is lowered inside of the hole. The annular support has a plurality of feet which are angularly distributed between the members, each one of the feet having a lower ground support wall and an upper wall forming an access ramp to the hole.

9 Claims, 2 Drawing Sheets

(56) References Cited

U.S. PATENT DOCUMENTS

| | | | | | |
|---|---|---|---|---|---|
| 2,508,100 | A * | 5/1950 | Clarke | A63B 71/04 | 473/187 |
| 3,801,107 | A * | 4/1974 | Martin | A63B 57/357 | 473/162 |
| 4,359,225 | A | 11/1982 | Baldorossi et al. | | |
| 5,487,545 | A * | 1/1996 | Schindler | A63B 57/357 | 473/187 |
| 5,588,918 | A | 12/1996 | Eckman et al. | | |
| 2008/0227560 | A1* | 9/2008 | Whitehouse | A63B 57/357 | 473/219 |

* cited by examiner

GOLF TRAINING DEVICE

CROSS-REFERENCE TO RELATED APPLICATIONS

This application claims the benefit of International application number PCT/EP2019/054060, filed Feb. 19, 2019 and French patent application number 1851577, filed on Feb. 23, 2018, the entire contents of which are incorporated herein by reference.

TECHNICAL FIELD

The invention relates to a golf training device.

It applies in particular to devices arranged to simulate a golf hole in order to allow a player to train in putting on any type of land, in particular indoors, with these devices comprising for this purpose an annular support wherein a golf hole is formed.

It is known, for example from document GB-1914/22584, devices of which the annular support is provided with a plurality of members angularly distributed with each one having an external ramp and an internal ramp, the members being arranged to allow a ball rolling at an adequate speed to enter the hole formed by the annular support, as would such a ball in a conventional golf hole.

To do this, the ramps are arranged to have a stable state, wherein the external ramp is arranged in a plane of access to the hole, in particular by being arranged bearing against the ground, the internal ramp being arranged protruding around the hole, and a constrained state by the passage of the ball on the external ramp, wherein the internal ramp is lowered inside of the hole in order to guide the ball into the hole.

Such devices do not provide full satisfaction, in that their bearing against the ground is provided mainly by the external ramps of members, while the bearing against the ground of the external ramps is modified when the members are in constrained contact. Thus, when the ball passes over the device, several adjacent members pass into the constrained state simultaneously, which tends to unbalance the base of the device.

SUMMARY OF THE INVENTION

The invention aims to perfect prior art by proposing in particular a golf training device that has a satisfactory stability on the ground, and this by simulating the behaviour of a golf hole as best as possible.

To this effect, the invention proposes a golf training device comprising an annular support wherein a hole for a golf ball is formed, the support being provided with a plurality of members angularly distributed with each one having an external ramp and an internal ramp, the ramps being arranged to have a stable state wherein the external ramp is arranged in a plane of access to the hole and the internal ramp is arranged protruding around the hole, and a state constrained by the passage of the ball on the member wherein the internal ramp is lowered inside of the hole, the annular support being provided with a plurality of feet which are angularly distributed between the members, each one of the feet having a lower ground support wall and an upper wall forming an access ramp to the hole.

BRIEF DESCRIPTION OF THE DRAWINGS

Other particularities and advantages of the invention shall appear in the following description, given in reference to the accompanying figures, wherein.

DETAILED DESCRIPTION

Figure 1:
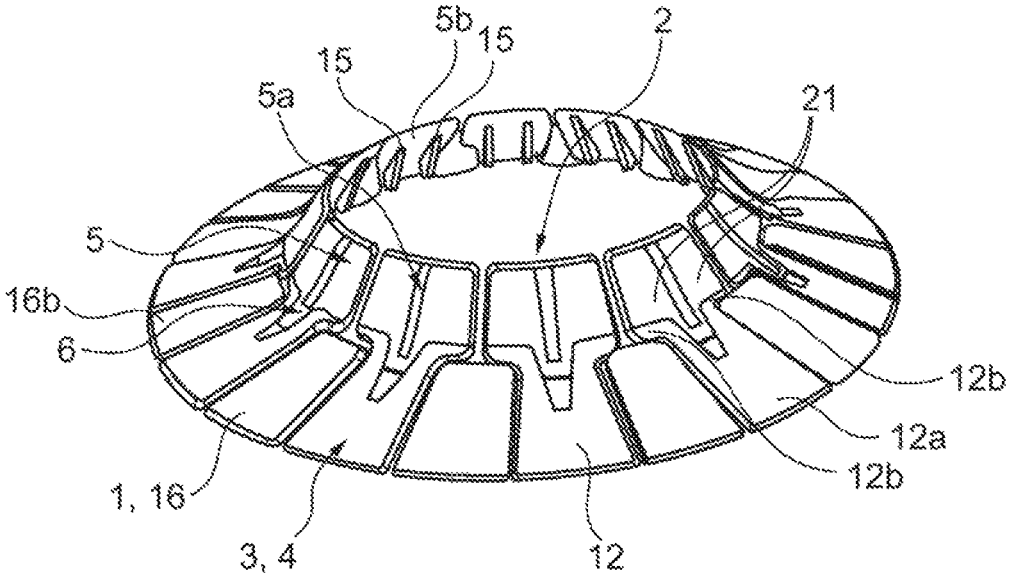
FIG. 1 is a perspective view of a golf training device according to the invention.

In relation with these figures, a golf training device is described hereinbelow.

The device is arranged to simulate a golf hole in order to allow a player to train in putting, and this on any type of land, in particular indoors. To do this, the device comprises an annular support 1 wherein a hole 2 for a golf ball is formed.

The support 1 is provided with a plurality of members 3 angularly distributed with each one having an external ramp 4 and an internal ramp 5, the ramps being arranged to have a stable state, wherein the external ramp 4 is arranged in a plane of access to the hole 2, in particular by being arranged bearing against the ground, and the internal ramp 5 is arranged protruding around the hole, as well as a constrained state, wherein the internal ramp 5 is lowered inside of the hole in order to guide the ball into the hole.

In the description, the terms "internal" and "external" define a positioning in space with respect to the hole 2. Thus, the term "internal" designates a position close to the hole 2 and the term "external" a position moved away from the hole.

Figure 3A:
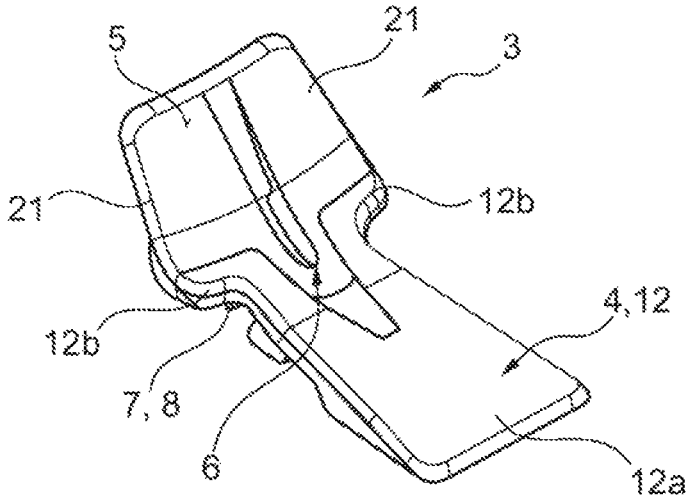
FIGS. 3*a* and 3*b* show a member of the device of FIG. 1, respectively in perspective (FIG. 3*a*) and as a side view (FIG. 3*b*)
Figure 3B:
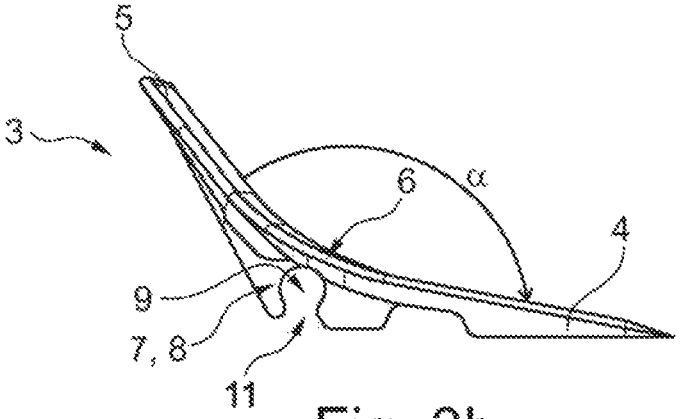

In relation in particular with FIG. 3*b*, the members 3 have a radius fillet 6 between the internal 4 and external 5 ramps, the ramps forming between them an angle $\alpha$ between 90° and 180°, in particular between 110° and 150°.

The internal ramp 5 has a length and an angle that are suitable for allowing entry into the hole 2 of a ball rolling at an adequate speed, but also the passing over it of a ball that is rolling too quickly, to allow the device to best simulate a conventional golf hole. In particular, internal ramps 5 that are too short and/or too flattened would not be suitable for simulating the entrance into the hole 2 of a ball rolling at an adequate speed. Likewise, a ball rolling too quickly could come up against internal ramps 5 that are too long and/or too high, and thus remain blocked in the hole 2.

In the embodiment shown, the members 3 are mounted in tipping on the support 1 between their stable and constrained states. To do this, as shown in FIG. 3*b*, the members 3 have a junction zone 7 between the external 4 and internal 5 ramps, in particular formed under the radius fillet 6, the zone being provided with a mounting structure 8 in rotation on the support 1.

More precisely, the mounting structure 8 has an upper housing 9 wherein an axis 10 formed on the annular support 1 is intended to be mounted in rotation, as well as a lower opening 11 that opens into the housing and arranged to allow for the mounting by snap-fitting of the axis 10 in the housing.

In particular, the mounting structure 8 is arranged to allow for the reversible mounting of the member 3 on the support 1, to allow for the possible replacing of the member, in particular in case of breakage and/or wear. To do this, the shape and/or the dimensions of the snap-fitting opening 11 can be adapted to allow for the removal of the axis 10 from the housing 9.

Advantageously, the internal ramp 5 is made from a material that is different from the external ramp 4, in particular from a material that has more flexibility than that of the external ramp, to allow for a damping of the ball when it passes on the internal ramp.

To do this, the members 3 are formed from a tab 12 whereon the external ramp 4 is formed, the tab being provided with an insert 13 whereon the internal ramp 5 extends.

Figure 4:
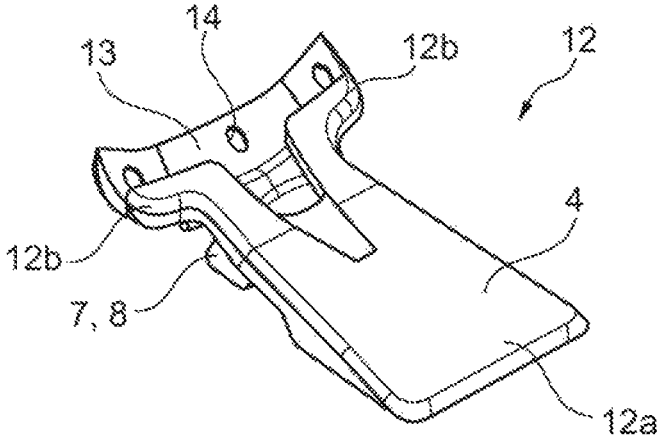
FIG. 4 is a perspective view of the external ramp of the member of FIGS. 3*a* and 3*b*.

The internal ramp 5 can in particular be carried out via overmoulding on the insert 13, to facilitate the manufacture of the member 3. In particular, as shown in FIG. 4, the insert 13 has anchoring orifices 14 wherein the material forming the internal ramp 5 is intended to flow during the overmoulding of the internal ramp in order to ensure the fastening thereof to the external ramp 4.

Furthermore, the mounting structure 8 is made from the same material with the tab 12, in particular by being formed in the lower portion of the insert 13, to have a rigidity that is sufficient to ensure the solidity of the mounting of the member 3 on the support 1.

Advantageously, the member 3 as a whole is carried out according to a distribution of mass which is arranged to place the centre of gravity of the member at a precise point of the mounting structure 8, in particular on the receiving housing 9 of the axis 10 of rotation, to ensure the stable state of the member.

In relation with FIG. 1, the internal ramps 5 has an external wall 5*a* whereon a ball is intended to roll, as well as an internal wall 5*b* whereon two reinforcing ribs 15 are formed.

The annular support 1 is provided with a plurality of feet 16 which are angularly distributed between the members 3, each one of the feet having a lower ground support wall 16*a* and an upper wall 16*b* forming an access ramp to the hole 2.

Thus, the feet 16 make it possible to offset the absence of support of the external ramps 4 of the members 3 in the constrained state, and therefore to ensure the stability on the ground of the device even when a ball passes over it. Furthermore, thanks to their access ramp 16*b*, the feet 16 can contribute to the guiding of the ball in the hole 2.

Advantageously, the access ramps 16*b* form with the external ramps 4 in the stable position a substantially continuous annular surface, which makes it possible to facilitate the passage of a ball over the external ramps.

To do this, the feet 16 are integrated into the support 1 by forming housings 17 between them wherein at least one member 3 is mounted, the housings having dimensions that are suitable for allowing the reception of the member with angular clearances of minimum sizes between the adjacent ramps 16*b*, 4. In the embodiment shown, the housings 17 each have dimensions that are suitable for receiving the external ramp 4 of a member 3.

Advantageously, a device can be provided with a substantial number of members 3, to improve the homogeneity of the behaviour of the device over its entire circumference. Thus, the embodiment shown provides twelve members 3.

In particular, the support 1 has bridges 18 connecting two adjacent feet 16, each bridge 18 having an axis 10 whereon the mounting structure 8 of a member 3 is mounted.

Advantageously, the annular support 1 is made from a single piece, in particular by moulding of a plastic material, which makes it possible to facilitate the manufacture thereof.

Figure 2A:
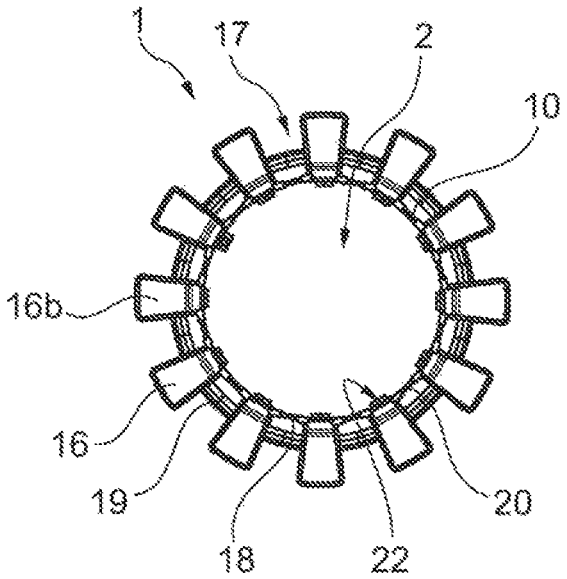
FIGS. 2*a* and 2*b* show the annular support of the device of FIG. 1, respectively as a top view (FIG. 2*a*) and as a bottom view (FIG. 2*b*)
Figure 2B:
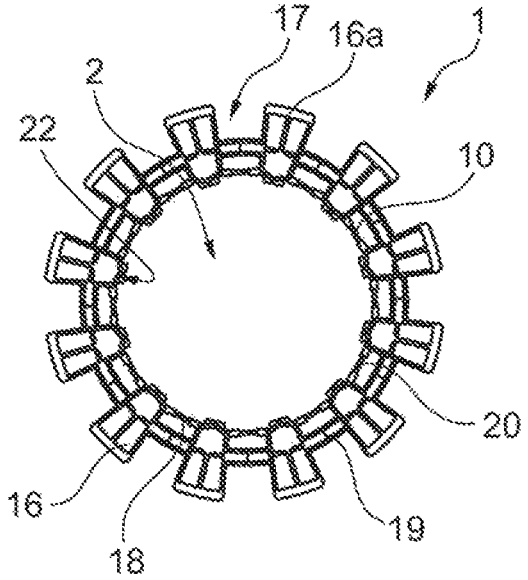

In relation with FIGS. 2*a* and 2*b*, the support 1 has an external annular structure 19 that connects the feet 16, as well as an internal annular structure 20 whereon are formed the mounting bridges 18 of the members 3.

The internal ramps 5 have lateral extensions 21 which are arranged overlapping at least one portion of the adjacent access ramp 16*b*. Thus, each access ramp 16*b* opens onto two internal ramps 5, which makes it possible to improve the continuity of the annular surfaces for the passing of a ball.

Moreover, the dimensions of the lateral extensions 21 are arranged to allow the internal ramps 5 in the stable state to form a substantially continuous annular surface, and thus facilitate the guiding of a ball into the hole 2 while still improving the aesthetical aspect of the device.

To do this, the tab 12 has a substantially T shape of which the stem 12*a* forms the external ramp and on the upper branches 12*b* of which extends the insert 13, the lateral extensions 21 each being moulded on respectively one upper branch 12*b*. Furthermore, the branches 12*b* facing two adjacent tabs 12 each extend by respectively overlapping one half of the internal end of the intermediate access ramp 16*b*.

Furthermore, each foot 16 comprises an extension 22 formed on the internal end thereof, and whereon the lateral extensions 21 and/or the adjacent branches 12*b* are intended to abut against during the passage of the corresponding members 3 in the constrained state, to limit the tipping of the members and to assist their return to a stable state.

What is claimed is:

1. A golf training device comprising an annular support wherein a hole for a golf ball is formed, the support being provided with a plurality of members angularly distributed with each one having an external ramp and an internal ramp, the ramps being arranged to have a stable state wherein the external ramp is arranged in a plane of access to the hole and the internal ramp is arranged protruding around the hole, and a constrained state by the passage of the ball on a member of the plurality of members wherein the internal ramp has lateral extensions which are dimensioned to overlap at least one portion of an adjacent access ramp and is lowered inside of the hole, the device wherein the annular support is provided with a plurality of feet which are angularly distributed between the plurality of members, each one of the feet having a lower ground support wall and an upper wall forming an access ramp to the hole.

2. The golf training device according to claim 1, wherein the plurality of members has a radius fillet between the internal and external ramps, the ramps forming between them an angle ($\alpha$) between 110° and 150°.

3. The golf training device according to claim 1, wherein the plurality of members has a lower reversible mounting structure on the support.

4. The golf training device according to claim 1, wherein the plurality of members is mounted on the annular support and configured to tip between the stable and constrained states.

5. The golf training device according to claim 4, wherein the plurality of members has a junction zone between the external and internal ramps, the junction zone being provided with a mounting structure on the annular support and configured to rotate with respect to the external and internal ramps.

6. The golf training device according to claim 1, wherein the plurality of feet is integrated into the annular support by forming housings between them wherein at least one member of the plurality of members is mounted.

7. The golf training device according to claim 6, wherein the annular support has a plurality of bridges connecting two adjacent said feet, the plurality of members being mounted on the plurality of bridges.

8. The golf training device according to claim 1, wherein the access ramps forms with the external ramp in the stable position a substantially continuous annular surface.

9. The golf training device according to claim 1, wherein the plurality of members are formed from a tab whereon the external ramp is formed, the tab being provided with an insert whereon the internal ramp extends.

* * * * *